US006499238B2

(12) United States Patent
Kluck et al.

(10) Patent No.: US 6,499,238 B2
(45) Date of Patent: Dec. 31, 2002

(54) SNOW THROWER WITH ELECTRIC CHUTE ROTATION AND DEFLECTOR CONTROL

(75) Inventors: Mark Kluck, Strongsville, OH (US); Robert Hilchey, Waterloo (CA)

(73) Assignee: MTD Products Inc, Cleveland, OH (US)

( * ) Notice: Subject to any disclaimer, the term of this patent is extended or adjusted under 35 U.S.C. 154(b) by 0 days.

(21) Appl. No.: 09/795,605

(22) Filed: Feb. 28, 2001

(65) Prior Publication Data

US 2001/0022042 A1 Sep. 20, 2001

Related U.S. Application Data

(60) Provisional application No. 60/190,880, filed on Mar. 21, 2000, and provisional application No. 60/186,008, filed on Mar. 1, 2000.

(51) Int. Cl.[7] ..... E01H 5/09
(52) U.S. Cl. ..... 37/261
(58) Field of Search ..... 37/244, 246, 248, 37/249, 254, 260; 74/340, 145, 473.3, 773.33, 488

(56) References Cited

U.S. PATENT DOCUMENTS 3,886,675 A * 6/1975 Maisonneuve et al.
4,011,668 A 3/1977 Gunderson ..... 37/43
4,205,468 A 6/1980 Greider ..... 37/43
4,255,881 A 3/1981 Fralish ..... 37/43
4,346,527 A 8/1982 Schmidt ..... 37/250
4,549,365 A * 10/1985 Johnson
4,651,452 A * 3/1987 Husso
4,862,607 A 9/1989 Wacker ..... 37/260
5,083,387 A * 1/1992 Tillotson et al.
5,174,053 A * 12/1992 Takeshita
5,315,771 A 5/1994 White, III et al. ..... 37/260
5,389,752 A 2/1995 Karbassi ..... 200/61.85
5,398,432 A * 3/1995 Vohl
5,438,770 A * 8/1995 Miller
5,444,927 A 8/1995 Sosenko ..... 37/260
5,743,347 A * 4/1998 Gingerich
6,061,617 A * 5/2000 Berger et al.
6,163,985 A 12/2000 Chinnery et al. ..... 37/234
6,327,798 B1 * 12/2001 Sakai et al.

* cited by examiner

*Primary Examiner*—Victor Batson
(74) *Attorney, Agent, or Firm*—Emerson & Skeriotis; Roger D. Emerson; Timothy D. Bennett

(57) ABSTRACT

A snow thrower comprised of a snow chute and chute deflector includes a joystick controller that may be adjusted between first, second, third and fourth positions. Adjustment of the joystick into one of the four positions causes rotation of the chute in clockwise and counterclockwise direction or causes the deflector to pivot upward or downward respectively. Both, the chute and the deflector are actuated by electric motors.

12 Claims, 5 Drawing Sheets

SNOW THROWER WITH ELECTRIC CHUTE ROTATION AND DEFLECTOR CONTROL

This application claims priority from U.S. Provisional Application, Ser. No. 60/190,880, filed on Mar. 21, 2000, titled SNOW THROWER WITH ELECTRIC CHUTE ROTATION AND DEFLECTOR CONTROL VIA A JOYSTICK and of U.S. Provisional Application, Ser. No. 60/186,008, filed on Mar. 1, 2000, titled SNOW THROWER WITH ELECTRIC CHUTE ROTATION AND DEFLECTOR CONTROL VIA A JOYSTICK.

I. BACKGROUND OF THE INVENTION

A. Field of Invention

The present invention relates to the art of snow throwers having a snow discharge chute and deflector; and, more specifically, related to the remote adjustment of the snow chute and deflector using a single joystick control.

B. Description of the Related Art

Snow throwers are well known in the art to include a snow chute and snow deflector through which snow is discharged from a snow-gathering unit. It is also known to provide remote, selective adjustment of the snow chute and deflector. In this manner, the operator can adjust the snow chute and deflector without leaving the control area of the snow thrower. In the case of a walk-behind snow-throwing unit, the operator can adjust the degree of rotation of the snow chute and the angle of the pivoting snow deflector from behind the steering handle. In the case of a riding snow throwing unit, the operator can adjust the snow chute and deflector without leaving the seat of the snow thrower riding unit. This provides for safe and convenient operation of the snow thrower.

One such invention is disclosed in U.S. Pat. No. 5,444,927 to Sosenko, which discloses an electrical-powered snow blower discharge chute adjustment mechanism, generally comprised of a meshingly-engaging gearing arrangement. A pre-positioned toggle switch is disclosed to be positioned at the operator station of the snow blower and is electrically connected to a motor, permitting the operator to selectively control the direction of rotation of the discharge chute. A snow deflector is also disclosed, to be pivotally attached to the chute outlet end for permitting control of the trajectory of the discharged snow, via a mechanical control linkage.

Known snow throwers may use a mechanical linkage to selectively adjust the position of the deflector. The linkage may be in the form of a cable or cables supplying only tension force in a plurality of directions facilitating movement of the deflector. The linkage may also be in the form of rigid linkage rods used in conjunction with springs. Some manufacturers purposely construct the adjustment mechanism so that a substantial resistive force is required to change the angle of the snow deflector. The resistive force is implemented so that operation of the snow thrower does not inadvertently change the angle of the snow deflector during regular usage. Both cables and linkages require substantial force from the operator to affect movement of the snow deflector. This may require the operator to let go of the snow thrower handles to use both hands to shift the mechanical device.

Known snow throwers may include separate controls for adjusting the rotation of the chute and for adjusting the angle of the snow deflector. Typically, this includes a mechanical lever connected to a mechanical linkage for adjustment of the snow deflector and may include an electrical switch for adjusting the rotation of the snow chute.

It would be advantageous to provide a snow thrower having a single control unit for adjusting both the snow chute and deflector. It would also be advantageous to provide a single control unit that works easily and consistently in all climates and temperatures. The invention of the present application accomplishes these advantages. The difficulties inherent in the art are therefore overcome in a way that is simple and efficient, while providing better and more advantageous results.

II. SUMMARY OF THE INVENTION

One object of the present invention is to provide a snow thrower having a single control lever for use in selectively adjusting both the snow chute and snow deflector.

It is another object of the present invention to provide electric motors to affect rotation of the chute and pivoting of the deflector.

It is yet another object of the invention to provide a joystick control as the single control lever.

It is still yet another object of the present invention to provide a plurality of directions of movement of the single control lever for adjustment of the snow chute and snow deflector.

It is yet another object of the present invention to provide a single control lever including a trigger switch.

According to the present invention, there is provided a snow thrower having a frame and ground-engaging wheels operatively coupled thereto. There is also provided a snow-gathering unit operatively attached to the frame and powered by a snow thrower engine, also attached to the frame. A snow chute is included being generally tubular in shape, and operatively communicated to the output of the snow-gathering unit at one end and operatively connected to a snow deflector at the distal end from which snow is discharged from the unit. The snow chute has fixedly attached thereto a gear or other power transferring means, which is operatively connected to an electric motor. Likewise, the snow deflector is operatively coupled to a second electric motor for use in adjusting the angle thereof. Each of the first and second electric motors is electrically connected to the single control lever or joystick.

The joystick may include first, second, third and fourth directions of movement. Adjustment of the joystick or lever in a first direction provides a signal to the electric motor to rotate the chute in a first direction. Adjustment of the joystick or lever in a second direction signals the electric motor to rotate the chute in an opposite direction. Similarly, adjustment of the joystick or lever in a third direction pivots the snow deflector upward. Likewise, adjustment of the joystick or lever in the fourth direction signals the second electric motor to adjust the snow deflector downward.

III. BRIEF DESCRIPTION OF THE DRAWINGS

The invention may take physical form in certain parts and arrangement of parts; a preferred embodiment of which will be described in detail in this specification and illustrated in the accompanying drawings, which form a part hereof and wherein.

Figure 2:
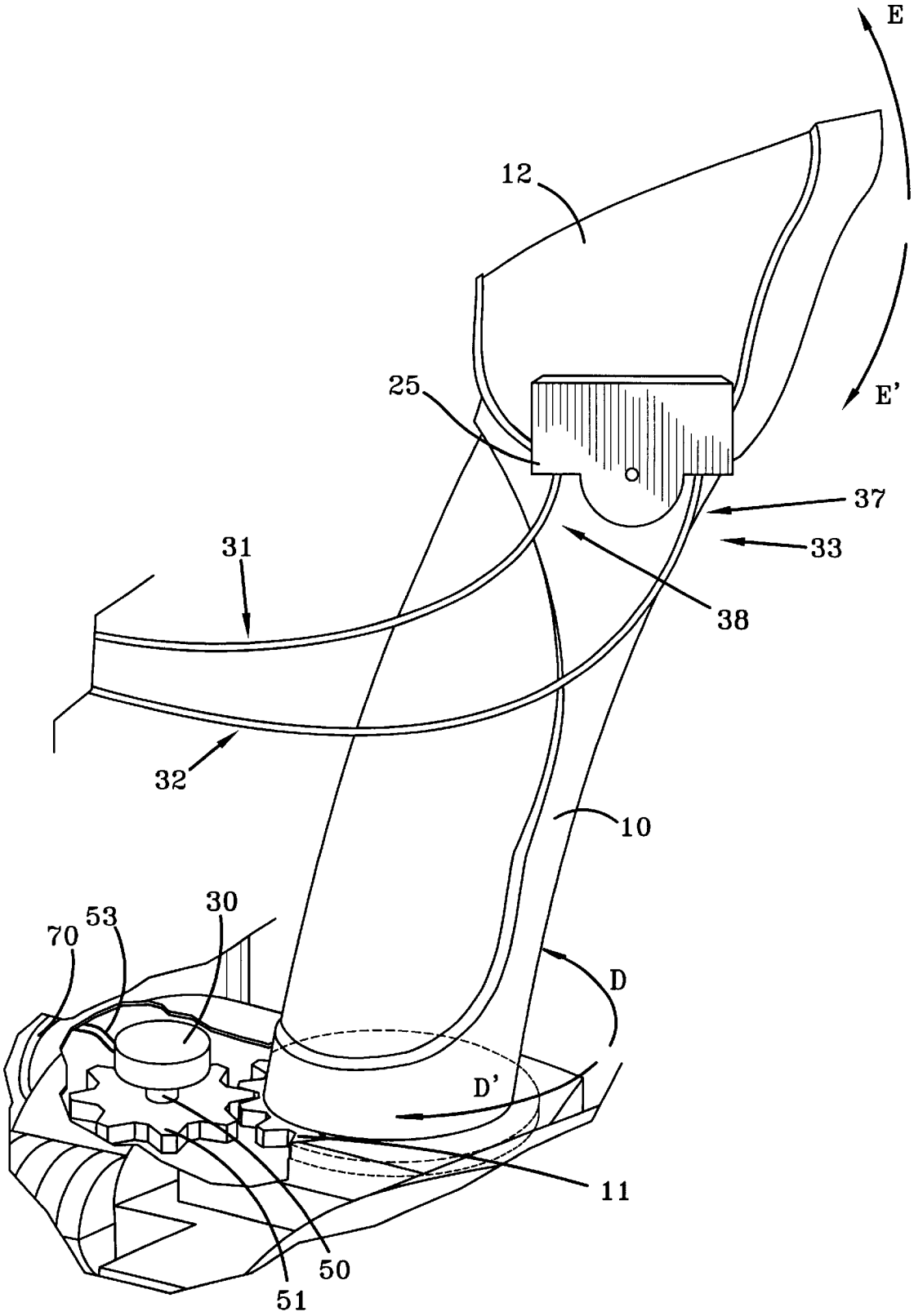
FIG. 2 is a perspective view of the snow thrower's snow chute and chute deflector.
Figure 2A:
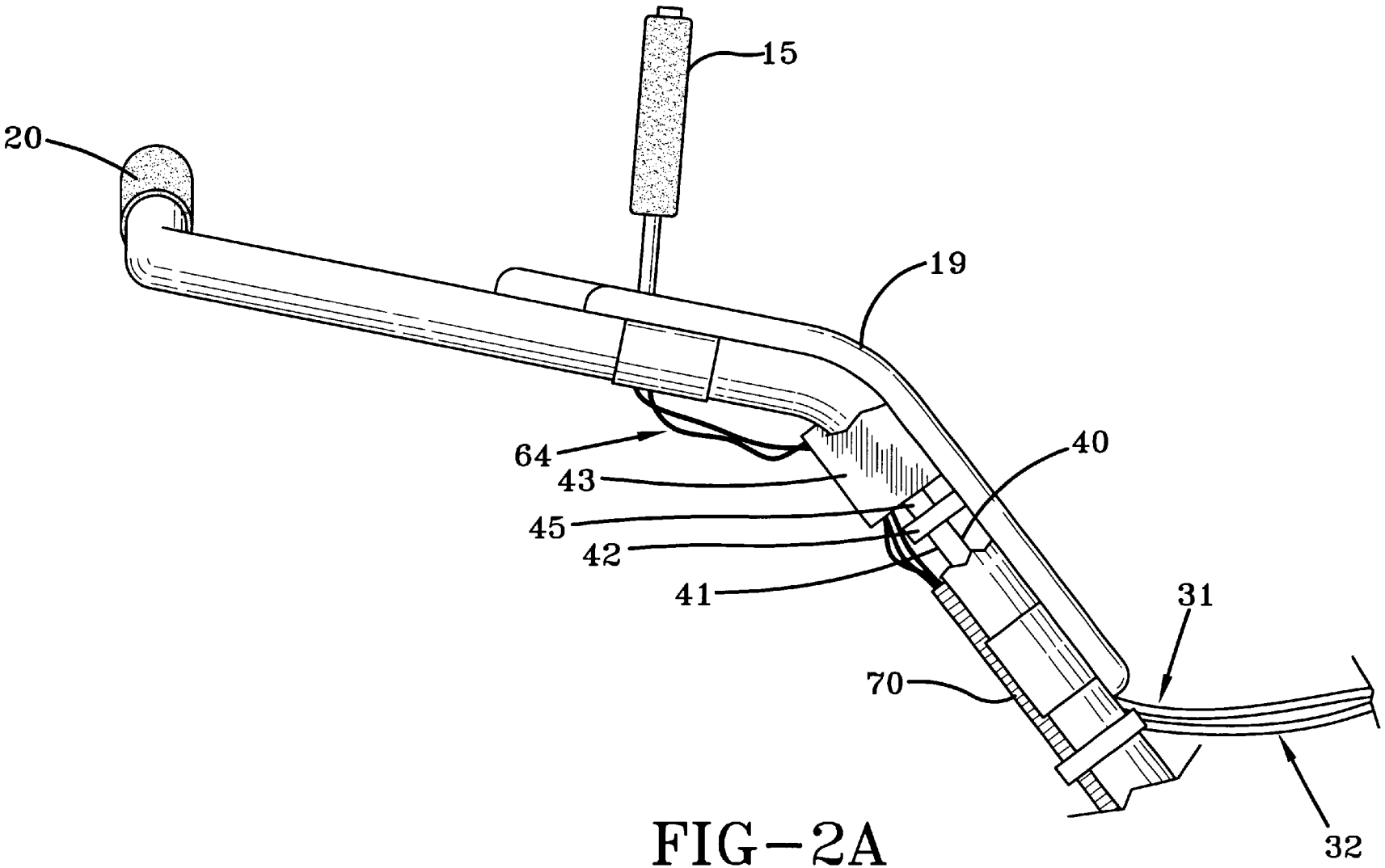

FIG. 2*a* is a cutaway perspective side view of the top of the steering handles and control panel.

Figure 2B:
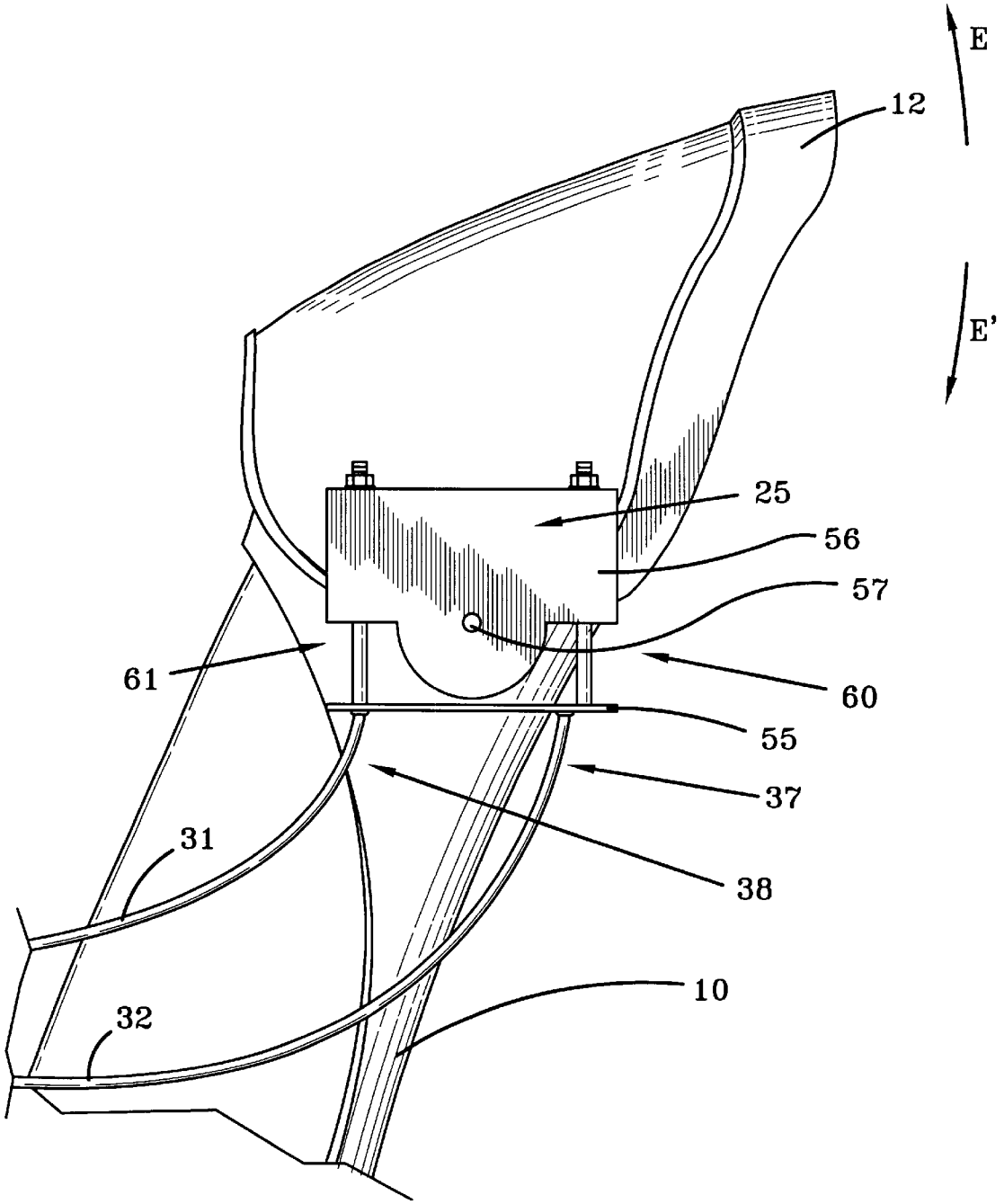

FIG. 2*b* is a side perspective view of the snow chute and snow deflector showing the pivoting mechanism.

Figure 3:
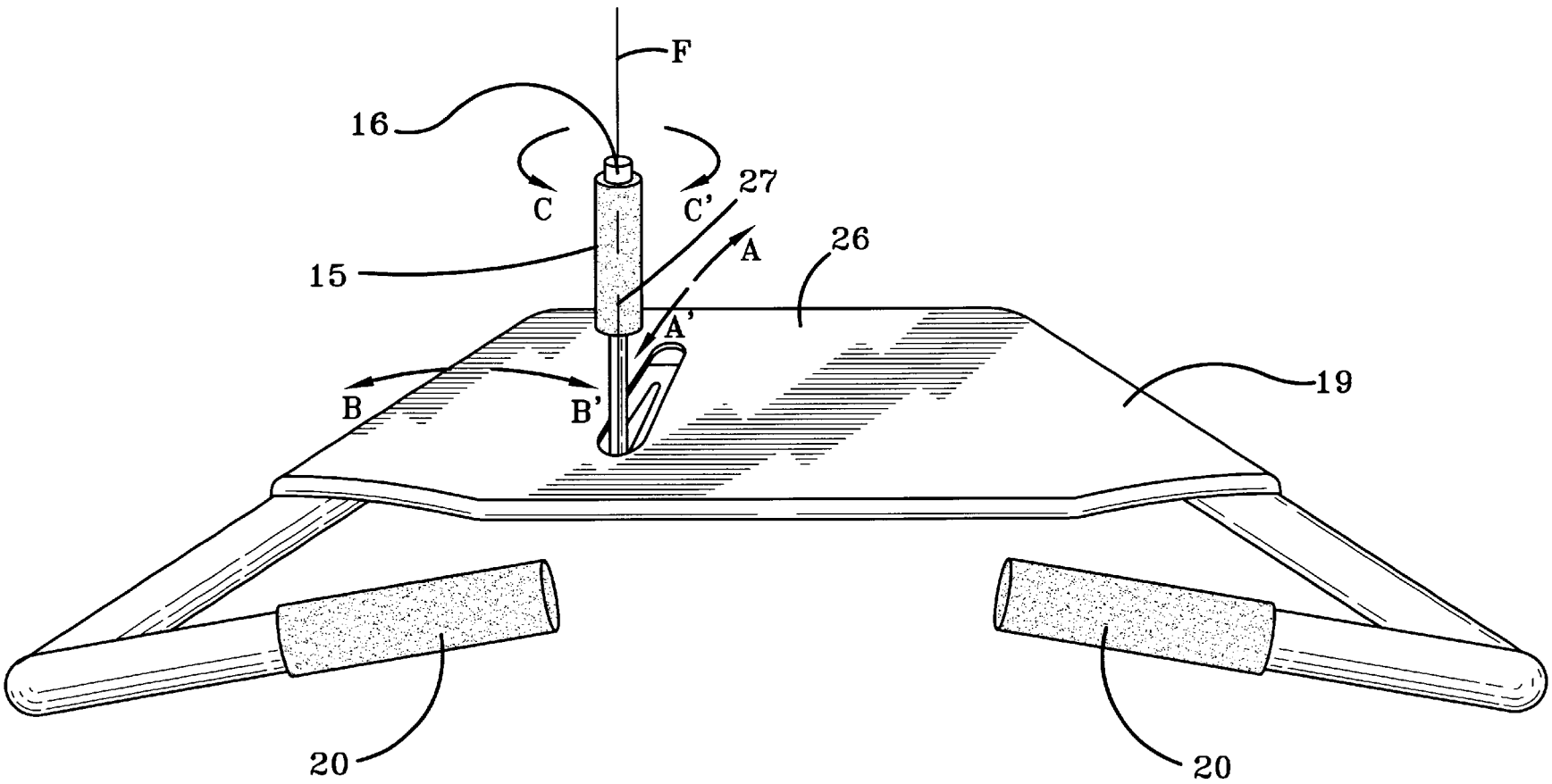

FIG. 3 is a perspective view of the control panel showing the single control lever.

IV. DESCRIPTION OF THE PREFERRED EMBODIMENT

Figure 1:
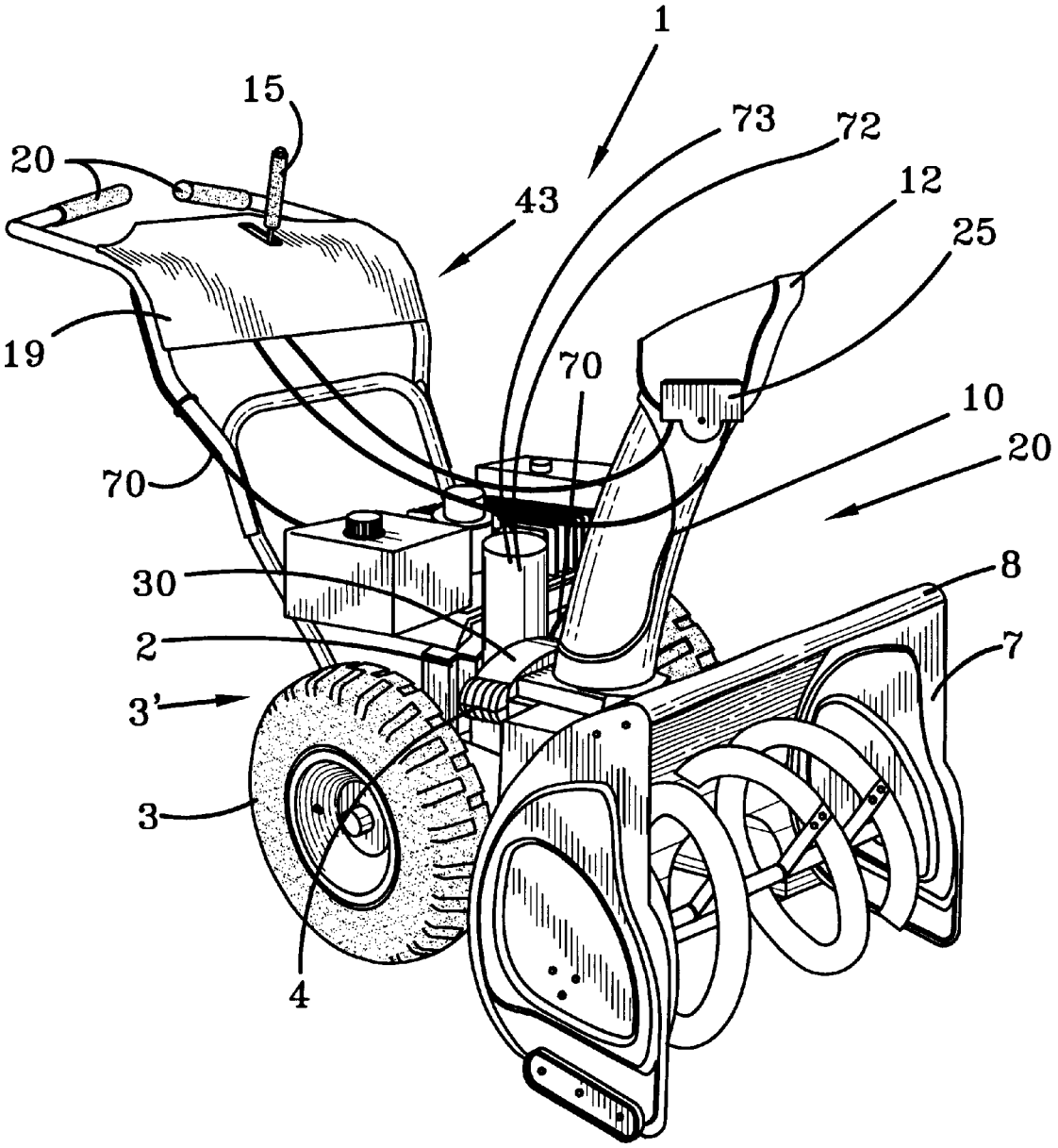
FIG. 1 is a perspective view of a walk-behind snow thrower.

Referring now to the drawings, wherein the showings are for purposes of illustrating a preferred embodiment of the invention only, and not for purposes of limiting the same, FIG. 1 shows a walk-behind snow thrower, shown generally at 1. The snow thrower includes a frame 2 and ground-engaging wheels 3, 3', operatively coupled to the frame. An engine 4 is fixedly attached to the frame 2 and provides power for operating a snow-gathering unit 7 attached to front end 23 of the snow thrower. In one embodiment, the engine 4 may be used to provide rotational power to the ground-engaging wheels 3, 3'. It is noted that the preferred embodiment relates to a walk-behind snow thrower. However, the present invention may be incorporated onto a riding vehicle having a snow-gathering unit attached thereto and other applications as well. According to the present invention, any type of snow-gathering unit 7 may be incorporated onto the snow thrower 1 as is chosen with sound engineering judgment. One example would be a dual stage snow-gathering unit. However, in the preferred embodiment, the snow-gathering unit 7 is a single stage unit. In that snow-gathering units 7 are well known in the art, no further explanation will be offered at this point. The snow-gathering unit 7 has a housing 8 and an opening through which snow is passed from the snow-gathering unit 7 to a snow chute 10. The snow chute 10 envelops the opening of the housing 8 so that snow passes from the snow gathering unit 7 into the snow chute 10. At an opposing end of the snow chute 10, a snow deflector 12 is pivotably attached thereto. The snow thrower 1 also includes handles 20, which are rigidly connected to the frame 2 so that an operator may maneuver the snow thrower as desired. The snow thrower 1 further includes a console or control panel 19 from which extends a joystick or single control lever 15. The single control lever 15 is used as a remote control device for rotating the snow chute 10 and pivoting the snow deflector 12 as will be discussed in subsequent paragraphs.

Referring now to FIG. 2, an electric motor 30 is shown in operable connection to the snow chute 10. In the preferred embodiment, the snow chute 10 includes a ring-like gear member 11 that is fixedly attached to the snow chute 10. The motor 30 includes a shaft 50 having a gear 51 extended therefrom, which meshes with the gear member 11 of the snow chute 10. As the motor 30 is operated, the gear 51 of the motor 30 rotates gear member 11, which in turn rotates snow chute 10. The motor 30 is operatively connected to the single control lever 15 via electrical conductors or wires 53 so that movement of the single control lever 15 into first and second positions causes the motor 30 to operate in first and second directions respectively, which further causes the snow chute 10 to rotate counterclockwise and clockwise respectively. In this way, the single control lever 15 controls rotational movement of the snow chute 10, which will be discussed in greater details in subsequent paragraphs.

With reference now to FIGS. 2, 2*a* and 2*b*, a pivoting mechanism 25 is shown operatively attached to the snow chute 10 and the snow deflector 12 at end 33 of the snow chute 10. In the preferred embodiment, the pivoting mechanism 25 includes a first bracket 55, shown in FIG. 2*b*, fixedly attached to the snow chute 10 and a second bracket 56 that is fixedly attached to the snow deflector 12. The second bracket 56 and the snow deflector 12 are pivotally connected with respect to the first bracket 55 and the snow chute 10 via pin 57 that extends into the snow deflector 12. At first ends 37, 38, cables 31, 32 are operatively attached to the brackets 55, 56 of the pivoting mechanism 25 and may transfer tension force to either of both sides 60, 61 of the pivoting mechanism 25 causing the snow deflector to pivot upwardly E or downwardly E'. The opposite ends 40, 41 of the cables 31, 32 are operatively attached to a gear reduction unit 42, as shown in FIG. 2*a*. The gear reduction unit 42 is communicated to a second motor 43 via a coupling mechanism 45. It is noted that the second motor 43 and gear reduction unit 42 may be mounted on the trimmer 10 at any place chosen with sound engineering judgment. However, in the preferred embodiment, the motor 43 and the gear reduction unit 42 may be mounted under the control panel 19 as shown. As the second motor 43 is selectively engaged, the gear reduction unit 42 is actuated in first and second directions. Cable 31 is operatively connected to the gear reduction unit 42 so that when the gear reduction unit 42 is actuated in a first direction, cable 31 transfers tension force to a first side 61 of the pivoting mechanism 25 causing the snow deflector 12 to pivot upwardly E. Likewise, cable 32 is operatively connected to the gear reduction unit 42 so that when the gear reduction unit 42 is actuated in a second direction, cable 32 translates tension force to a second side 60 of the pivoting mechanism 25 causing the snow deflector 12 to pivot downwardly E'. In this manner, selectively engaging the second motor 43 causes the gear reduction unit 42 to actuate, which in turn applies a tension force to one of either of the cables 31, 32 causing the snow deflector 12 to pivot upwardly E or downwardly E' respectively. The motor 43 is actuated by the single control lever 15, via electrical conductors or wires 64, so that movement of the single control lever 15 into third and fourth positions causes the motor 43 to operate in first and second directions respectively, which further causes the snow deflector 12 to pivot as previously discussed.

Referring now to FIG. 3, a single control lever 15 is shown extending from an upper surface 26 of the control panel 19. The single control lever 15 may be a joystick controller 27 selectively adjustable in a plurality of positions and directions. Movement of the single control lever 15 in any of the plurality of adjustable positions actuates one or both of the electric motors 30, 43 further facilitating movement of either the snow chute 10 or the snow deflector 12 respectively. In the preferred embodiment, the single control lever 15 is a joystick 27 that is linearly adjustable along two separate and substantially perpendicular axes, as indicated by arrows A, A' and B, B'. Movement of the joystick 27 in the direction A causes the chute deflector 12 to pivot upwards, indicated in FIG. 2 by the arrow E, while movement of the joystick 27 in the direction A' causes the chute deflector 12 to pivot downward, as indicated in FIG. 2 by the arrow E'. Additionally, adjustment of the joystick 27 in the direction B causes the snow chute 10 to rotate in a counterclockwise direction, as designated by the arrow D shown in FIG. 2. Similarly, adjustment of the joystick 27 in the direction B' causes rotation of the snow chute in the clockwise direction D'. The joystick 27 includes biasing means, not shown, that automatically returns the joystick 27 to a non-actuating or neutral position when the operator releases the joystick 27. In the preferred embodiment, the biasing means includes a spring for biasing the joystick into the neutral position. However, any means of returning the joystick to the neutral position may be chosen with sound engineering judgment. In this manner, the operator may precisely and effortlessly control both the rotation of the snow chute 10 and the pivoting of the chute deflector 12 with one hand.

With continued reference to FIG. 3, an alternate embodiment is also contemplated. The joystick 27 may be constructed to rotate about a longitudinal axis F of the joystick 27 in directions C and C' in substitution for adjustment of the joystick 27 in directions B and B'. In this embodiment, rotation of the joystick 27 about the axis F in the C direction causes rotation of the snow chute in the counterclockwise direction. Likewise, rotation of the joystick 27 in the C' direction causes the snow chute 12 to rotate clockwise. Adjustment of the joystick 27 for pivoting of the chute deflector 12 is not changed from the previous embodiment. In other words, pivoting the chute deflector 12 is still actuated by linear adjusting the joystick 27 in the A and A' directions. Adjustment of the joystick 27 in this way more closely resembles the actual motion of the snow chute 10 and chute deflector 12 respectively.

With continued reference to FIG. 3, yet another embodiment also contemplated. This embodiment includes a trigger switch 16 which may be selectively depressed between first and second positions via toggling. By toggling it is meant that depressing the trigger switch 16 once releases the toggle switch 16 from a first position and holds the toggle switch 16 in a second position. Depressing the toggle switch 16 again releases the toggle switch 16 from the second position and holds the toggle switch in the first position. In this way, upon each subsequent depression of the trigger switch 16, the trigger switch 16 is toggled back and forth between the first and second positions. In this embodiment, the joystick 27 is only adjusted along a single line, indicated by the arrows A and A'. With the trigger switch 16 in the first toggle position, adjustment of the joystick 27 in the A direction causes rotation of the snow chute 10 in a counterclockwise direction. And likewise, adjusting the joystick 27 in the A' direction causes rotation of the snow chute 10 in a clockwise direction. With the trigger switch 16 in the second toggle position, adjustment the joystick 27 in the A direction causes the chute deflector 12 to pivot upward. And similarly, adjusting the joystick 27 in the A' direction causes the chute deflector 12 to pivot downward.

With continued reference to FIGS. 1, 2 and 2*a*, an electrical generating means 72 is coupled to an output of the engine 4 for use in supplying electrical power to the motors 30, 43. In the preferred embodiment, the electrical generating means 72 is an alternator 73, shown in FIG. 1. Electrical power is selectively communicated via joystick 27 through electrical conductors 53, 64 between the electrical output of the alternator 73 and the motors 30, 43 for use in rotating the snow chute 10 and for use in pivoting the snow deflector 12 as previously discussed. A cable harness 70 is shown extending from the joystick 27 and the motor 43 to the engine 4 and to the electric motor 30. The cable harness 70 receives the electrical conductors 53, 64 for use in protecting the electrical conductors during normal use of the snow thrower 1.

In summary, the present invention incorporates an electric motor 43, selectively controlled by a joystick 27, for providing tension force to one of two cables 31, 32 which operatively pivots the snow deflector 12. Likewise, the same joystick 27, selectively adjusted, engages the electric motor 30, which in turn rotates the snow chute 10. In other words, adjusting the joystick 27 in a first position causes the snow chute 10 to rotate counterclockwise. Adjusting the joystick 27 in a second position causes the snow chute 10 to rotate clockwise. Adjusting the joystick 27 in a third position causes the snow deflector 12 to pivot upward. And adjusting the joystick 27 in a fourth position causes the snow deflector 12 to pivot downward. From the description of the aforementioned embodiments of the present invention, it is clearly seen that a snow chute 10 and snow deflector 12, both actuated by a single joystick controller is safely, conveniently and precisely operated by the operator with one hand, without the use of excessive force and without leaving the operator station. In this way, the advantages of the present invention are clearly seen.

Although the present invention has been described in considerable detail with reference to certain preferred versions thereof, other versions are possible. Therefore, the sphere and scope of the appended claims should not be limited to the description of the preferred versions contained herein.

What is claimed is:

1. A walk behind snow thrower, comprising:

a frame;

a handle operatively attached to said frame for use in maneuvering said walk behind snow thrower;

at least a first ground engaging wheel operatively connected to said frame;

an engine operatively connected to said frame;

a snow-gathering unit operatively connected to said frame;

a snow chute in operable communication with said snow-gathering unit, said snow chute being rotatably attached with respect to said snow-gathering unit;

a snow deflector being pivotally attached with respect to said snow chute;

an electrical actuator operatively connected to pivot said snow deflector;

a single control lever operatively mounted to said frame, said single control lever being in operable communication with said snow chute for use in rotating said snow chute, said single control lever being in operable communication with said electrical actuator for use in pivoting said snow deflector; and, wherein said single control lever is mounted proximate to said handle for use in providing remote control of said snow chute and said snow deflector.

2. The snow thrower of claim 1, wherein said single control lever is selectively adjustable between first and second positions, when said single control lever is adjusted into said first position said snow chute rotates in a counterclockwise direction, and, when said single control lever is adjusted in said second position said snow chute rotates in a clockwise direction.

3. The snow thrower of claim 2, wherein said single control lever is also selectively adjustable between third and fourth positions, when said single control lever is adjusted into said third position said snow deflector pivots upwardly, and, when said single control lever is adjusted into said fourth position said snow deflector pivots downwardly.

4. The snow thrower of claim 2, wherein said single control lever is rotated counterclockwise into said first position, and wherein said single control lever is rotated clockwise into said second position.

5. The snow thrower of claim 2, wherein said single control lever is displaced linearly in a first direction into said first position, and wherein said single control lever is displaced linearly in a second direction into said second position.

6. The snow thrower of claim 1, wherein said single control lever is a joystick, and wherein said electrical actuator is an electric motor operatively connected to said snow deflector, wherein said electric motor is in operative communication with said joystick, and, wherein said electric motor is selectively engaged by said joystick.

7. The snow thrower of claim 6, further comprising:

a gear reducing means operatively coupled to an output of said electric motor; and, at least a first cable operatively communicated between said gear reducing means and said snow deflector for use in pivoting said snow deflector.

8. A walk behind snow thrower, comprising:

a frame;

a handle operatively attached to said frame;

at least a first ground engaging wheel operatively connected to said frame;

an engine operatively connected to said frame;

a snow-gathering unit operatively connected to said frame;

a snow chute in operable communication with said snow-gathering unit, said snow chute being rotatably attached with respect to said snow-gathering unit;

a snow deflector being pivotally attached with respect to said snow chute; and, a single control lever in operable communication with said snow chute and said snow deflector for use in rotating said snow chute and pivoting said snow deflector;

wherein said single control lever is selectively adjustable between first, second, third and fourth positions, and, when said single control lever is adjusted into said first position said snow chute rotates in a counterclockwise direction, and, when said single control lever is adjusted in said second position said snow chute rotates in a clockwise direction, and, wherein said single control lever is displaced linearly in a first direction into said third position, wherein said single control lever is displaced linearly in a second direction into said fourth position, and, when said single control lever is adjusted into said third position said snow deflector pivots upwardly, and, when said single control lever is adjusted into said fourth position said snow deflector pivots downwardly.

9. The walk behind snow thrower of claim 8, wherein said single control lever is rotated in a first direction into said first position, and wherein said single control lever is rotated in a second direction into said second position.

10. The walk behind snow thrower of claim 8, wherein said single control lever is displaced linearly in a first direction into said first position, and wherein said single control lever is displaced linearly in a second direction into said second position.

11. The walk behind snow thrower of claim 9 or 10, further comprising:

an electric motor operatively connected to said snow deflector, said electric motor being in operative communication with said single control lever, wherein said electric motor is selectively engaged by said single control lever.

12. A snow thrower, comprising:

a frame;

at least a first ground engaging wheel operatively connected to said frame;

an engine operatively connected to said frame;

a snow-gathering unit operatively connected to said frame;

a snow chute in operable communication with said snow-gathering unit, said snow chute being rotatably attached with respect to said snow-gathering unit;

a snow deflector being pivotally attached with respect to said snow chute;

a joystick in operable communication with said snow chute and said snow deflector for use in rotating said snow chute and pivoting said snow deflector; and, a trigger switch operatively communicated to said joystick, wherein said trigger switch is received by said joystick;

wherein when said trigger switch is depressed into a first toggle position and when said joystick is adjusted into a first position said snow chute rotates in a counterclockwise direction, and, when said trigger switch is depressed into said first toggle position and when said joystick is adjusted into a second position said snow chute rotates clockwise direction, and, when said trigger switch is depressed into a second toggle position and when said joystick is adjusted into said first position said snow deflector pivots upward, and, when said trigger switch is depressed into said second toggle position and when said joystick is adjusted into said second position said snow deflector pivots downward.

* * * * *